United States Patent [19]

Miyakawa et al.

[11] 4,139,299

[45] Feb. 13, 1979

[54] AUTO-BIAS DEVELOPING APPARATUS

[75] Inventors: Seiichi Miyakawa, Nagareyama; Susumu Tatsumi, Kawasaki, both of Japan

[73] Assignee: Ricoh Company, Ltd., Japan

[21] Appl. No.: 671,835

[22] Filed: Mar. 30, 1976

[30] Foreign Application Priority Data

Apr. 4, 1975 [JP] Japan ..... 50-41589

[51] Int. Cl.[2] ..... G03G 15/10

[52] U.S. Cl. ..... 355/10; 96/1 LY; 118/647

[58] Field of Search ..... 355/10, 14; 118/647, 118/DIG. 23; 96/1 LY

[56] References Cited

U.S. PATENT DOCUMENTS

| | | | |
|---|---|---|---|
| 3,576,623 | 4/1971 | Snelling | 355/10 |
| 3,782,818 | 1/1974 | Smith | 355/10 |
| 3,892,481 | 1/1975 | Schaefer et al. | 355/10 |
| 3,944,356 | 3/1976 | Hayne | 355/3 CH |
| 3,980,049 | 9/1976 | Tasumi et al. | 355/10 |
| 3,981,267 | 9/1976 | Gardiner et al. | 355/10 |

*Primary Examiner*—A. D. Pellinen

[57] ABSTRACT

The process and device are for use in an electrophotographic copying machine using a developing agent of liquid type. A counter-electrode is maintained closely spaced from the peripheral surface of a photosensitive drum bearing an electrostatic latent image thereon and itself electrically floating. The developing solution, which inherently has a substantial conductivity is supplied into the space between the drum surface and the counter-electrode so as to develop the latent image. During the development of latent image, a weak d.c. current flow, is passed between the counter-electrode and the drum through the segment of the developing solution filling the space so that a good relation between potentials on the drum surface and the counter-electrode is obtained to eliminate background smearing. The d.c. current may be controlled to decrease in value as the induced potential on the counter-electrode increases.

3 Claims, 6 Drawing Figures

AUTO-BIAS DEVELOPING APPARATUS

BACKGROUND OF THE INVENTION

The invention relates to an auto-bias developing process and apparatus for carrying out the same in an electrophotographic copying machine of the so-called wet developing type.

As a recent trend in the business maintenance work, an increasing number of originals having a colored background is copied by an electronic copying machine. An original having a colored background exhibits a reflectivity which is reduced relatively to that of an orignal having a white background, and is therefore susceptible to a background smearing in the copy obtained. To prevent such a background smearing in the wet developing system, either the amount of exposure or the bias applied to a counter-electrode must be adjusted. In the former case, a troublesome operation is required of a user of the machine to adjust the amount of exposure in accordance with an individual original. In the latter case, there has been a proposal to provide an automatic bias in which the potential of an electrostatic latent image on an image carrier is detected so as to determine a bias voltage applied to a counter-electrode in accordance with the detected potential. However, the arrangement is complex and therefore is expensive.

SUMMARY OF THE INVENTION

It is an object of the invention to provide an auto-bias developing process capable of completely preventing a background smearing with a very simple mechanism.

DETAILED DESCRIPTION OF PREFERRED EMBODIMENTS OF THE INVENTION

Figure 1:
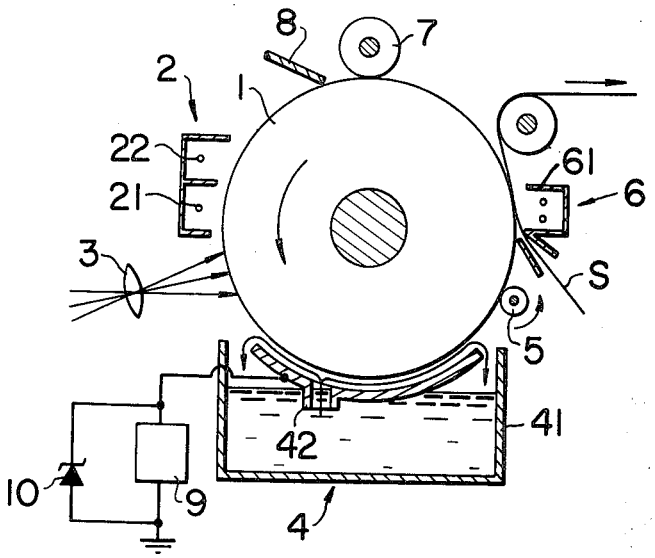
FIG. 1 a schematic side elevation of an electronic copying machine to which the invention is applied.

In the drawings, the electronic copying machine to which the invention is applied is only schematically illustrated since the construction of such machine itself is well known and has no direct bearing on the invention. Specifically, the machine includes a photosensitive member 1 in the form of a drum forming a conductive substrate for a photosensitive layer, a charger 2, an exposure optical system 3, a developing unit 4, a squeeze roller 5, a transfer unit 6, a cleaning roller 7 and a cleaning blade 8. In accordance with the invention, a constant current source 9 and a Zener diode 10 are connected in parallel and connected with a developing dishplate 42 as will be further described later.

A copying operation takes place as follows: As the photosensitive member 1 initiates its rotation in the direction indicated by an arrow, a discharge takes place from a d.c. corona discharge electrode 21 contained within the charger 2, whereby the surface of the member 1 is uniformly charged. For the convenience of description, it is assumed that the photoconductor of the member 1 comprises selenium. In this instance, its surface is charged to the positive polarity. The drum surface is imagewise exposed through the optical system 3, and an electrostatic latent image is formed thereon and is subsequently converted into a visual image by the developing unit 4. The developing unit 4 includes a tank 41 which contains a quantity of developing solution, a developing dishplate 42 which is disposed in conformity to and closely spaced from the drum surface, and a pump (not shown) which pumps the developing solution from the tank 41 into the space between the drum surface and the dishplate 42. When the space is filled with the developing solution, negatively charged toner particles contained within the developing solution undergo electrophoresis within the mother liquor of the developing solution under the influence of the electric field formed by the electrostatic latent image, and are attached to the latent image, thus converting it into a visual image. The dishplate 42 has a conductive surface at least on its side facing the drum 1, and is electrically isolated from other members except for its connection with a constant voltage source, thus forming a floating counterelectrode. Subsequent to the developing step, any excess amount of developing solution which wets the drum is removed therefrom by the squeeze roller 5, which is very closely spaced from the drum surface and which rotates in the same direction as the drum 1 with a rotational speed which depends on the speed of rotation of the drum 1. A record sheet S is introduced into the space between the drum 1 and a transfer charger 61 contained in the transfer unit 6, and is disposed in superimposed relationship with the visual image on the drum, whereupon the visual image is transferred from the drum surface onto the record sheet S by applying a corona discharge of positive polarity to the rear surface of the sheet from the transfer charger 61. The record sheet S having the visual image transferred thereto is subsequently separated from the drum surface, and delivered to the exterior of the machine after any necessary processing. Any residual toner on the drum surface is cleaned by the cleaning roller 7 and blade 8, and any charge remaining on the drum surface is eliminated by an a.c. corona discharge from an electrode 22 contained in the charger 2.

Assume now that an original has a pale blue background and for the convenience of description, it is assumed that no image is formed on the original. In this instance, the surface potential of the drum 1 subsequent to the exposure will be a uniform background potential, which is designated by $V_S$. When the exposed surface of the drum comes opposite to the developing dishplate 42, a surface potential $V_E$ will be induced thereon by the known counter-electrode effect, and which is proportional to the potential $V_S$. However, the coefficient of proportionality is less than unity, and is determined by the shape, material and position of the dishplate 42. If the surface potential of the dishplate 42 is produced only by the floating counter-electrode effect, it is less than the background potential $V_S$ of the drum, so that, in the developing station, the toner particles will be subjected to an electrostatic force which is directed toward the drum surface. Hence, toner will be attached to the drum surface, which represents the above mentioned background smearing.

Figure 2:
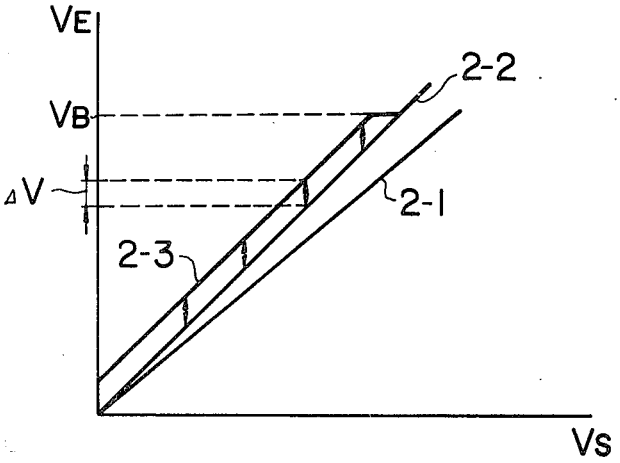
FIG. 2 graphically illustrates the operation of the invention.

What is intended by the present invention is to prevent the attachment of the toner to the drum under such situation. The value of $V_S$ obviously depends on the optical density and the variety of the background color of the original. The bias potential $V_E$ induced, only by the counter-electrode effect when no constant voltage source is connected to dishplate 42, on the surface of the developing dishplate 42 varies in accordance with a curve or line 2-1 shown in FIG. 2. It is interesting to consider the application of the bias potential $V_E$ to the dishplate 42 when it the bias potential $V_E$ is maintained equal to $V_S$, as when dishplate 42 is connected to a constant voltage source. In this instance, there exists no electric field, across the drum 1 and the dishplate 42, which functions to cause a migration of the toner in any direction, so that there could be no attachment of the toner to the drum surface except that produced by a natural adherence. In other words, no background smearing will be produced in a region above a line 2—2 shown in FIG. 2.

Assume now that a weak, constant current is forcedly passed from the constant current source 9 to the dishplate 42. The charge injected into the dishplate 42, acting as the electrode of a capacitor by such current flow will add to the bias potential induced by the counter-electrode effect, and when the potential of the dishplate 42 rises above the uniform background potential $V_S$ of the drum surface, there will be a small current flow from the dishplate 42 to the drum surface through the developing solution which fills the space therebetween. Representing the electrical resistance presented by the developing solution in this space, which remains substantially constant, by r and the magnitude of the weak current which is forcedly passed from the source 9 to the dishplate 42 by $\Delta I$, the dishplate 42 will be at a potential which is by $\Delta V = r\Delta I$ higher than the background potential $V_S$ of the drum when there is a current flow from the dishplate 42 toward the drum surface. When the surface potential $V_S$ of the drum 1 changes to cause a variation in the potential which is induced on the developing dishplate 42 by the counter-electrode effect, the surface potential $V_E$ of the dishplate 42 may be represented by a line 2-3 shown in FIG. 2, since $\Delta V$ remains substantially constant. This means that the background smearing is completely prevented. When the original contains an image area, the potential induced on the dishplate 42 by the counter-electrode effect will be proportional to the average potential of the latent image, and therefore the above discussion will be also applicable if the background potential $V_S$ is replaced by an average potential of the latent image. Again, the potential of the dishplate 42 is maintained at a potential which is by $\Delta V$ higher than the average potential $V_S$ of the latent image, irrespective of surface potential of the drum 1, thus assuring a complete elimination of the background smearing.

It should be borne in mind that the current which is forcedly passed to the floating counter-electrode or developing dishplate 42 must be a weak one. If the current flow is increased, the developing effect will be influenced by such current flow. In addition, since an increase in the current flow results in an increase in the value of $\Delta V$, the biasing will have the adverse effect of reducing the optical density of the visual image formed. A weak current, as termed herein, should desirably be less than 20 microamperes. Where the original contains a large area of black image, a forced flow of the weak current causes the auto-biasing of the invention to function in an unintended manner to degrade the optical density of the image. The purpose of the Zener diode 10 connected in shunt with the constant current source 9 serves to prevent such an adverse effect. Specifically, as the area of black image on the original increases to increase the average potential $V_S$ of the latent image above a given value $V_B$, the weak current from the source will be shunted by the Zener diode, thus preventing the developing dishplate 42 from assuming an excessively high potential.

Figure 3:
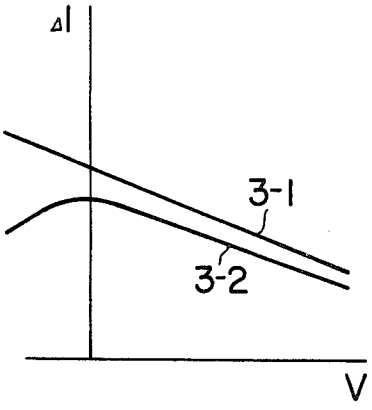
FIG. 3 graphically shows the characteristics of two current sources which are practically available to the process of the invention.
Figure 4:
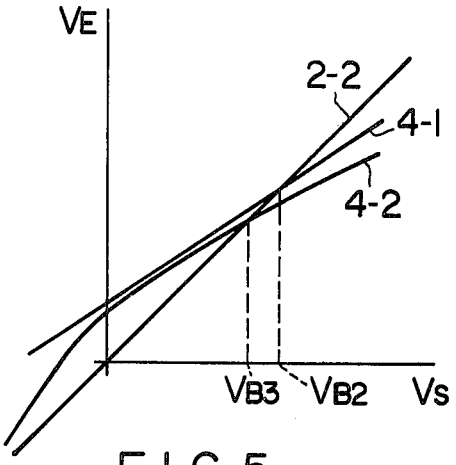
FIG. 4 is a view similar to FIG. 2, showing a variation of the characteristic when the current sources shown in FIG. 3 are employed.

In the above description, the weak current which is forcedly passed to the floating counter-electrode has been described as constant, but from a practical point of view, it need not be constant. For example, the current source may have a current-voltage characteristic as illustrated in FIG. 3. When a current source is used which exhibits the current-voltage characteristic represented by a curve 3-1 in FIG. 3, the relationship between the potential $V_E$ of the floating counter-electrode and the average potential $V_S$ of the latent image on the drum will be represented by a curve 4-1 shown in FIG. 4. For a current source exhibiting the characteristic indicated by a curve 3-2 in FIG. 2, the relationship will be represented by a curve 4-2 in FIG. 4. In each of these instances, a background smearing will result when the average potential $V_S$ exceeds $V_{B2}$ or $V_{B3}$. Thus, the current sources exhibiting the characteristic as indicated in FIG. 3 can be used for practical purposes by choosing the average potential of the latent image $V_S$ to be below $V_{B2}$ or $V_{B3}$.

Figure 5:
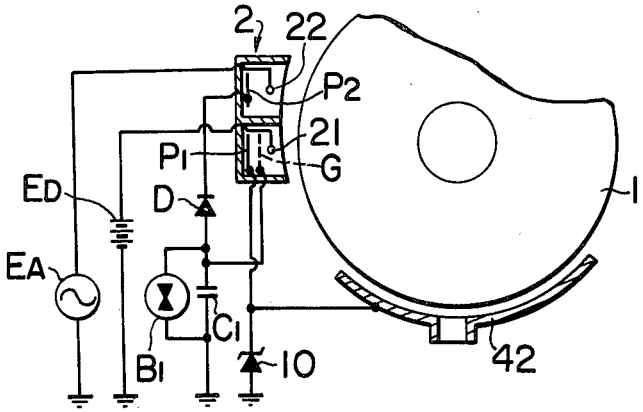
FIG. 5 is a schematic side elevation of a modification of the machine shown in FIG. 1, in which a charger is utilized as a current source.

FIG. 5 shows the construction of the charger 2 in more detail. Specifically, an a.c. source $E_A$ is connected with the a.c. corona discharge electrode 22, and a d.c. source $E_D$ is connected with the d.c. corona discharge electrode 21. A conductive plate $P_1$ is disposed behind the electrode 21 and a grid G is disposed between the plate $P_1$ and the electrode 21. Similarly, a conductive plate $P_2$ is disposed behind the electrode 22. A diode D has its cathode connected with the conductive plate $P_2$ and its anode connected with a capacitor $C_1$, which is shunted by a varistor $B_1$, and the other end of which is connected with the ground. The diode rectifies the alternating current flowing from the electrode 22 to the plate $P_2$, and a constant voltage on the order of $-500$ volts is derived from the junction between the diode and the capacitor for application to the grid G. The current source thus formed exhibited a current-voltage characteristic which is similar to the curve 3-1 shown in FIG. 3, and the current which is forcedly passed to the developing dishplate 42 was about 0.5 microampere. A series of originals having backgrounds of various colors were used to effect a copying operation, and it was found that a satisfactory copy, completely free from background smearing, was obtained without requiring any adjustment of the amount of the exposure.

Figure 6:
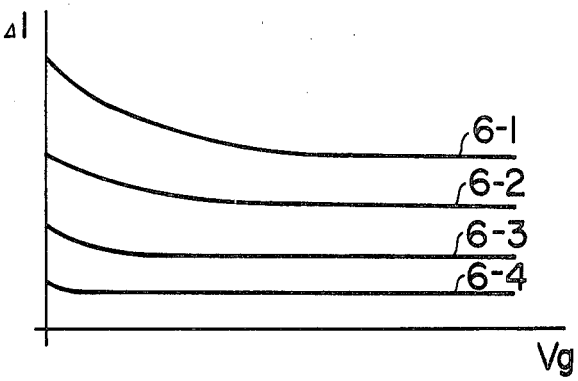
FIG. 6 graphically shows a family of characteristics of the current source shown in FIG. 5 and which are obtained by changing the distance between the plate and the d.c. corona discharge electrode while avoiding the use of a grid.

It should be understood that the corona discharger which is used as a current source for the developing dishplate is not limited to the one which charges the drum surface, but may equally be a transfer charger or a cleaning charger. A control voltage may be applied directly to the grid G from a d.c. source, or alternatively the grid may be connected in series with a resistor or a Zener diode having a suitable threshold value. In addition, the grid G may be dispensed with, and a suitable bias potential may be applied to the plate $P_1$. In this instance, the magnitude of the weak current forcedly passed to the developing dishplate 42 can be controlled by changing the area of the plate $P_1$ or the distance between the plate $P_1$ and the electrode 21. By way of example, when a brass plate measuring 12mm × 70mm is used for the plate $P_1$, and a discharge voltage of +6300 volts is applied to the d.c. corona discharge electrode 21 while applying a bias potential from 0 to 500 volts to the plate $P_1$, it is found that the weak current $\Delta I$ is approximately 10 to 15 microamperes when the distance between the plate and the electrode is 10mm. When the distance was increased to 12mm, the current $\Delta I$ changed to approximately 4 to 5 microamperes. The current source thus formed exhibited current-voltage characteristics as shown in FIG. 6, wherein the curves 6-1, 6-2, 6-3 and 6-4 correspond to an increasing distance between the plate $P_1$ and the d.c. corona discharge electrode 22. It will be noted that the current approaches a constant value as the bias $V_g$ applied to the plate $P_1$ is increased. Instead of using the grid G, the plate $P_1$ may have its surface covered by an insulating film, such as Milar film, which is suitably formed with a plurality of apertures of a given area in the form of windows, thus providing a control over the magnitude of the weak current. The aperture may be single or a plurality of apertures may be suitably spaced so that the total area of the apertures is maintained constant. For example, a single aperture measuring 5mm × 5mm may be provided or alternatively a pair of apertures measuring 2.5mm × 5mm may be provided. As a further alternative, four apertures each measuring 2.5mm × 2.5mm may be provided. It was found that the current-voltage characteristic approaches that of a constant current source as the size of the apertures is reduced and its number increased. In one example used for the experiments, it is found that a suitable value for the total area of the apertures is 5mm × 5mm.

From the foregoing, it will be apprecitated that the invention has provided an auto-bias developing process which completely eliminates a background smearing in a simple manner. It will be also appreciated that, during mass production of electronic copying machines, the amount of light emitted by the exposure lamps may vary from machine to machine, thus requiring an adjustment in the light emission of the individual machines. However, with the invention, such adjustment can be eliminated. In addition, an adjustment of exposure in accordance with each individual original is no longer required of a user of the machine. Finally, it should be understood that the invention is not limited to the developing process mentioned above, but is equally applicable to a liquid cascade developing process.

What is claimed is:

1. An auto-bias developing device for use in an electrophotographic apparatus having means including a photosensitive layer for forming an electrostatic latent image, and a d.c. discharger having an electrode spaced from said layer, said device comprising:

a developing electrode closely spaced from the outer surface of said layer and adapted so there can be induced thereon, by the counter-electrode effect, a potential proportional to the average surface potential on said layer;

means for supplying a developing solution into the space between said layer and said developing electrode so as to develop a latent image on said layer; and means for supplying current to said developing electrode, said current supplying means including a conductive plate member disposed opposite the electrode of said d.c. discharger, a voltage regulating element connecting said plate member to ground, means connecting a junction, between said plate member and said voltage regulating element, to said developing electrode, a grid interposed between said electrode of said d.c. discharger and said plate member, and means for supplying a control voltage to said grid.

2. A device according to claim 1, for use in an electrophotographic apparatus which further includes an a.c. discharger having an electrode, said control voltage supplying means including a conductive second plate member disposed opposite the electrode of said a.c. discharger, and circuit means including a voltage rectifying element connecting said second plate member and said grid.

3. A device according to claim 1, further including circuit means connected across said grid for regulating the control voltage supplied thereto.

* * * * *